United States Patent [19]

Arneson

[11] 3,981,397

[45] Sept. 21, 1976

[54] ARTICLE CARRIER

[75] Inventor: Edwin L. Arneson, Hillsdale, N.J.

[73] Assignee: Federal Paper Board Company, Inc., Montvale, N.J.

[22] Filed: Aug. 18, 1972

[21] Appl. No.: 281,999

[52] U.S. Cl. ..... 206/178; 206/171; 206/186; 229/52 BC

[51] Int. Cl.[2] ..... B65D 75/00

[58] Field of Search ..... 220/113, 110, 111, 112, 220/115; 229/28 BC, 52 BC, 40; 206/65 C, 170–193

[56] References Cited

UNITED STATES PATENTS

| | | | |
|---|---|---|---|
| 2,537,615 | 1/1951 | Arneson | 229/28 BC |
| 2,587,808 | 3/1952 | Arneson | 220/113 |
| 2,645,403 | 7/1953 | Arneson | 220/113 |
| 2,785,827 | 3/1957 | Forrer | 220/113 |
| 3,589,593 | 6/1971 | Weiss | 206/65 C |
| 3,752,356 | 8/1973 | Forrer | 220/115 |

*Primary Examiner*—William Price
*Assistant Examiner*—Allan N. Shoap
*Attorney, Agent, or Firm*—Guy A. Greenawalt

[57] ABSTRACT

A collapsible carrier for bottled beverages which is formed from a blank of paperboad or similar material and which is cut and creased so that it may be folded and glued to provide, when set up, a bottom wall, upstanding side and end walls, and a handle and partition structure which includes a longitudinal center partition and cross straps extending on opposite sides thereof which divide the carrier into bottle receiving cells, the longitudinal partition including a handle portion at the top and inturned riser panels at the ends thereof which connect the same to the end walls. The carrier is collapsible on corner hinge lines with bottom wall forming panels extending from the side walls in disconnected relation and having interlocking elements for connecting these panels when the carrier is set up and the panels are moved into coplanar bottom wall forming relation.

5 Claims, 8 Drawing Figures

FIG. 1
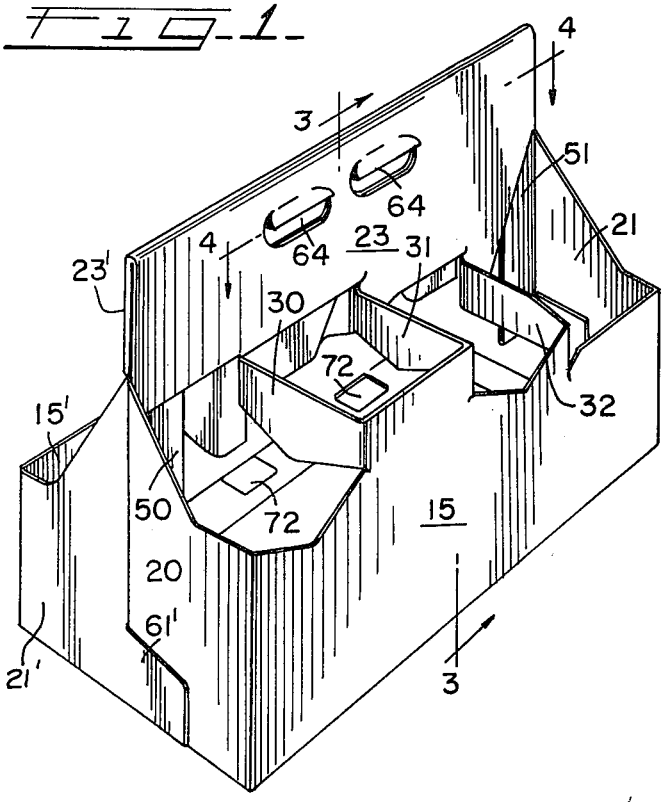
FIG. 2
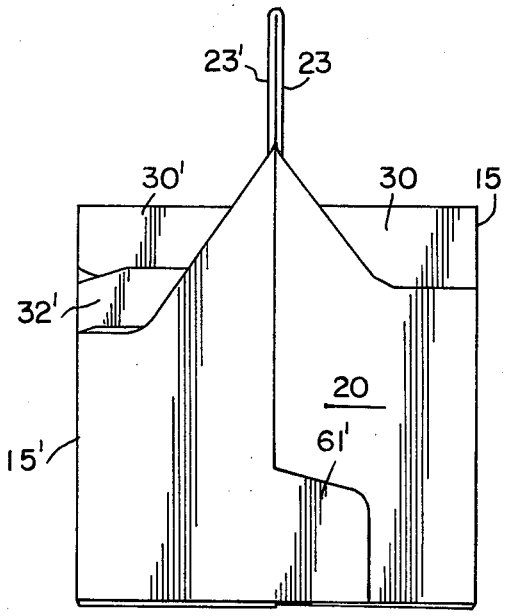
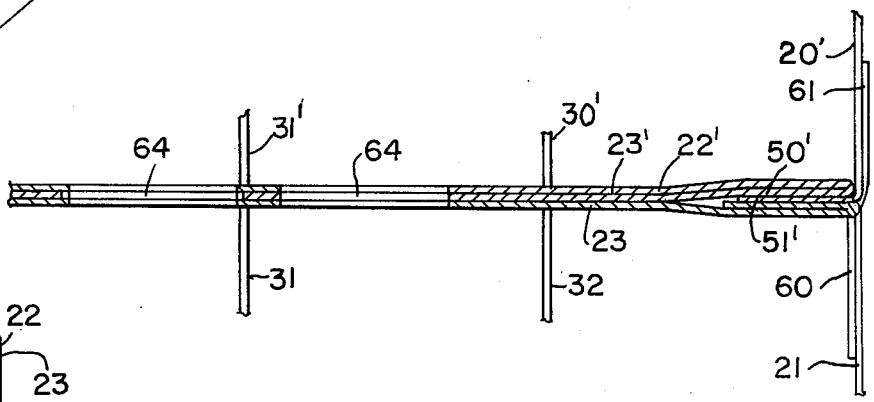
FIG. 4
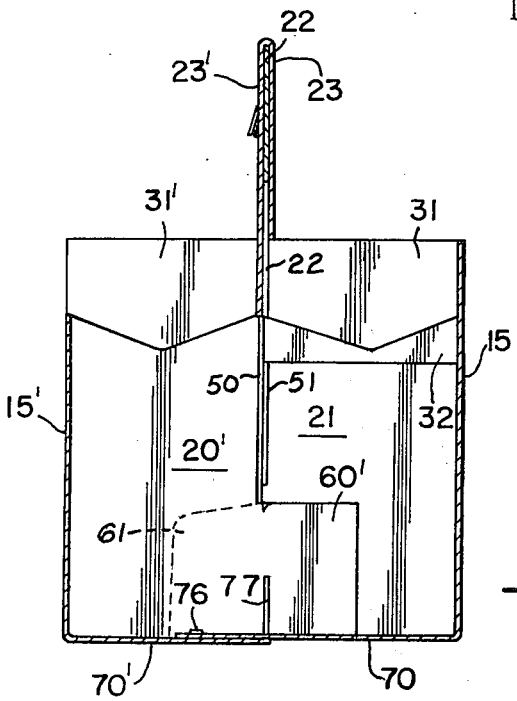
FIG. 3

77
77
74
73
75
75
76
76
76
76
70'
60'
10
61'
16'
71'
72
17'
15'
26'
21'
20'
24'
25'
36'
31'
27'
11
32'
50'
30'
51'
52'
34'
23'
53'
22'
64'
64'
37'
64
37
65
55'
57
14
64
22
55
63
23
41
34
50
47
45
43
31
36
30
35
12
51
62
32
42
25
24
53
27
44
46
40
33
52
21
17
26
20
56
15
54
16
71
61'
72
60
78
78
70

77
76
70'
60'
10
72
61
15'
21'
52'
20'
16'
31'
32'
50'
30'
51'
55'
22'
64'
37'
23'
57
55
22
53
23
64
51
35
30
52
32
31
50
24
21
27
15
56
20
54
16
17
72
61
60

ARTICLE CARRIER

This invention relates to article carriers of a type which are fabricated from a single blank of flexible sheet material, with the blank being cut and creased to divide the same into a plurality of panels which are foldable into predetermined relation so as to provide, when in an article receiving position, twin compartments, separated by a longitudinally extending center partition and handle structure, with each compartment subdivided into a multiplicity of article accommodating cells by means of cross partition straps extending between the center partition structure and the oppositely disposed side walls and spaced longitudinally of the carrier.

Carriers for bottled beverages and like products have heretofore been provided which have been formed from a cut and scored blank of foldable sheet material so as to provide a series of panels which are connected by suitable adhesive to form, when set up, a cellular basket-type carrier. Typical carriers of this type are disclosed in my U.S. Pat. Nos. 2,645,403, dated July 14, 1953, and 3,140,797, dated July 14, 1964. The most widely used of these carriers collapses and folds in the center of the end panel which results in a certain degree of weakness in the end panel structure and in the connection between the longitudinal partition and the end wall panels. While this type carrier may be designed with the handle panels taken from the middle of the blank or with the bottom wall panels taken from the middle portion of the blank, generally the latter arrangement has been employed which limits the carrier to use with top loading equipment. These and other disadvantages of this type carrier have restricted its use. It is a general object, therefore, of the present invention to provide a cross strap-type basket carrier which may be fabricated from a single blank which is cut and scored so as to form, when fabricated, a collapsible basket-type multicellular bottle carrier which is adapted for loading through the bottom and which collapses on the corner scores rather than collapsing in the center of the end panels, thereby providing a much more stable carrier, which is at the same time, economical to manufacture and also adapted to be handled on available high speed packaging machinery without the need for substantial alteration of the machinery.

A more specific object of the invention is to provide an improved cross strap, basket-type, multicellular bottle carrier which is collapsible, which hinges at the corner scores, and which may be formed with either inclined or horizontally disposed partition straps.

A further object of the invention is to provide an improved basket-type, multicellular bottle carrier having a longitudinal center partition structure which comprises a pair of outer panels folded upon a top center fold line and inner reinforcing panels hinged to end edge portions of the outer panels, which partition structure is connected at its opposite ends to pairs of end wall forming panels by riser panels integrally hinged to the end wall panels and to opposite side wall forming panels by cross partition forming straps taken from the top margins of the side wall panels, with the partition structure, cross straps, riser panels and wall forming panels arranged so as to enable the carrier to be fabricated in collapsed condition and to be opened up for loading through the bottom by hinging upon oppositely disposed corner fold lines.

A still further object of the invention is to provide a collapsible, multicellular, basket-type bottle carrier with an improved longitudinal center partition and handle structure which is connected to the side wall forming panels by spaced cross straps and to the end wall forming panels by hinged riser panels which extend from the end wall panels and enable the collapsing of the carrier upon oppositely disposed corner hinged forming lines, with bottom wall forming panels which are hinged to the bottom edges of the side wall forming panels and which have overlapping marginal portions with locking elements adapted to be interengaged when the carrier is squared up and loaded through the bottom and these panels are moved into coplanar bottom closing relation.

These and other objects and advantages of the invention will be apparent from a consideration of the bottle carrier structure which is shown by way of illustration in the accompanying drawings wherein:

FIG. 1 is a perspective view of an article carrier in set up, empty condition which has incorporated therein the principal features of the invention;

FIG. 2 is an end elevation of the carrier shown in FIG. 1;

FIG. 3 is a cross sectional view taken on the line 3—3 of FIG. 1;

FIG. 4 is a partial, longitudinal section taken on the line 4—4 of FIG. 1;

Figure 5:
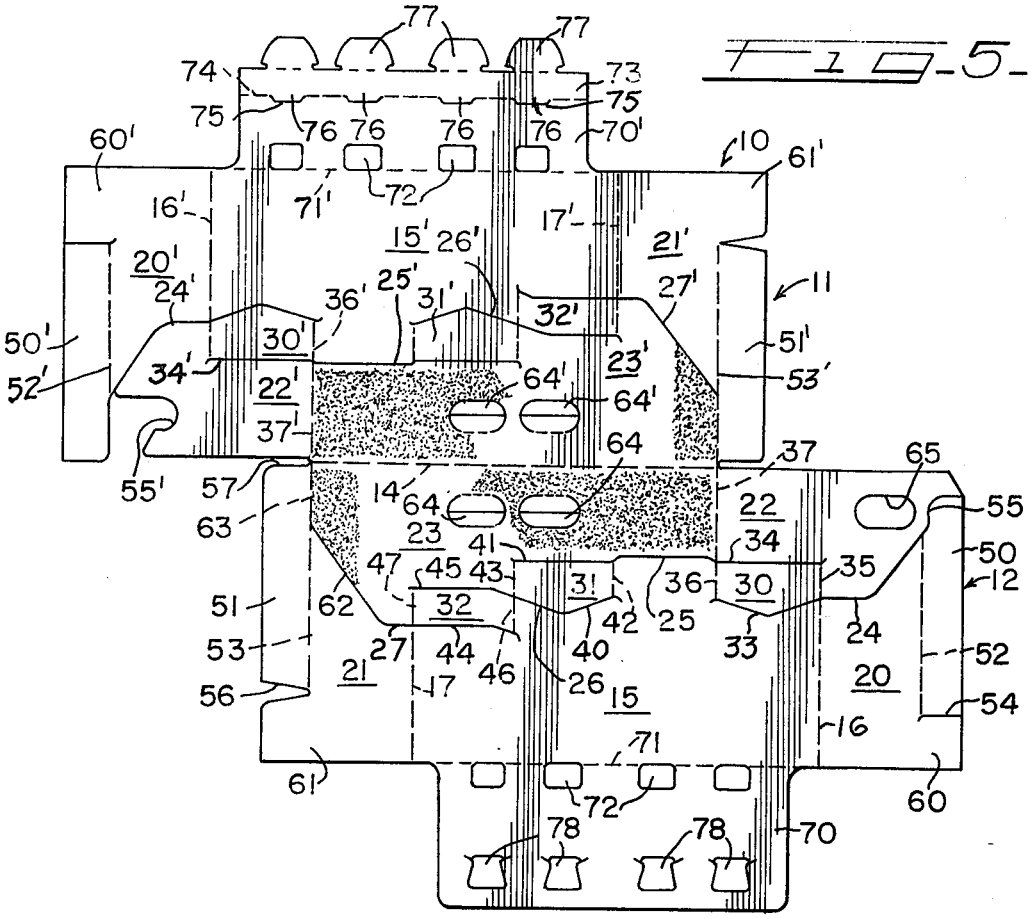
FIG. 5 is a plan view of the inside face of the prepared blank from which the carrier is formed, the view showing adhesive applied to certain areas of the blank preliminary to execution of the first folding operation.
Figure 6:
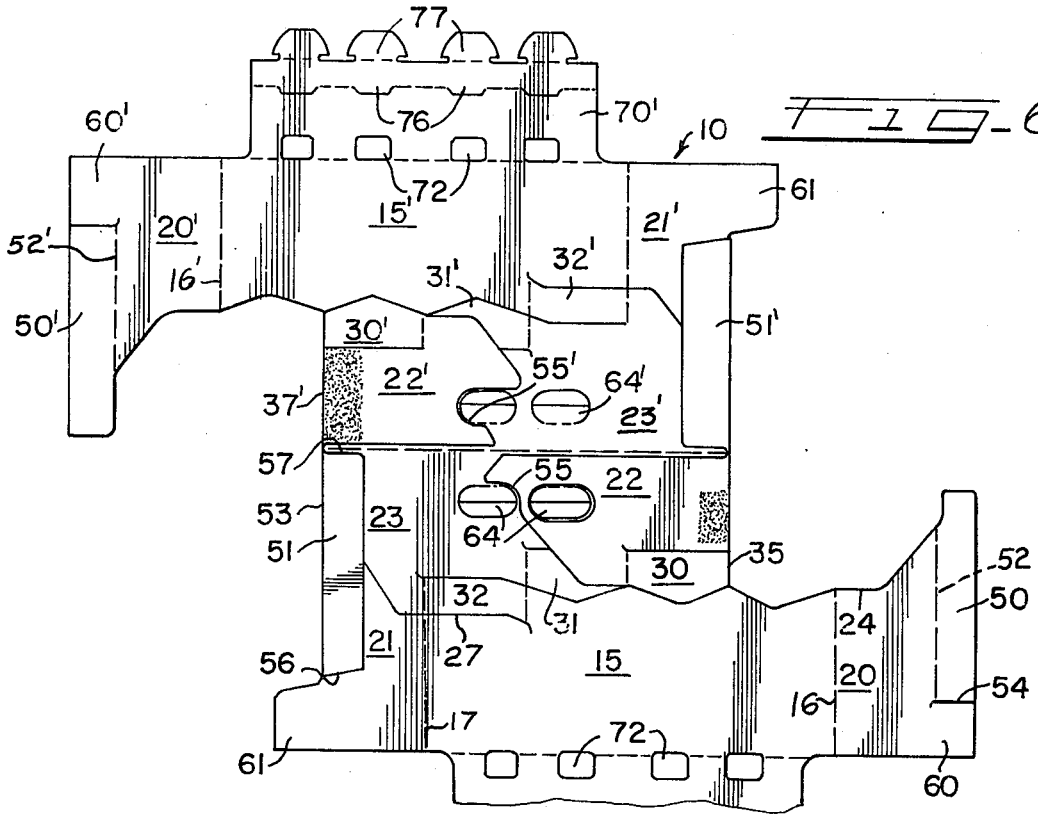
FIG. 6 is a plan view of the blank shown in FIG. 5 following certain folding and adhesive-applying operations.
Figure 7:
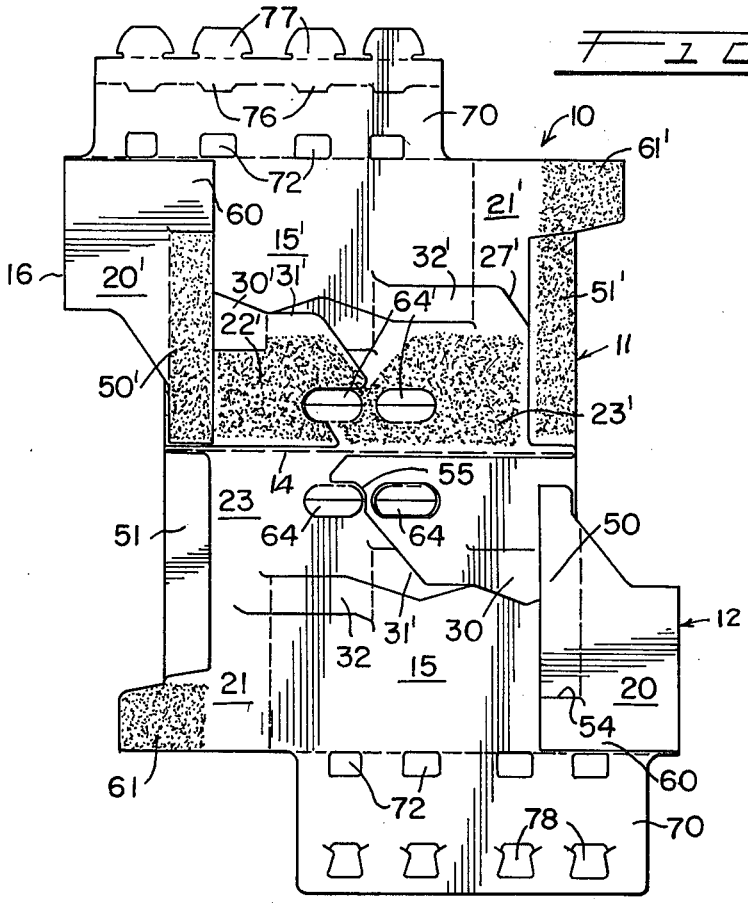
Figure 8:
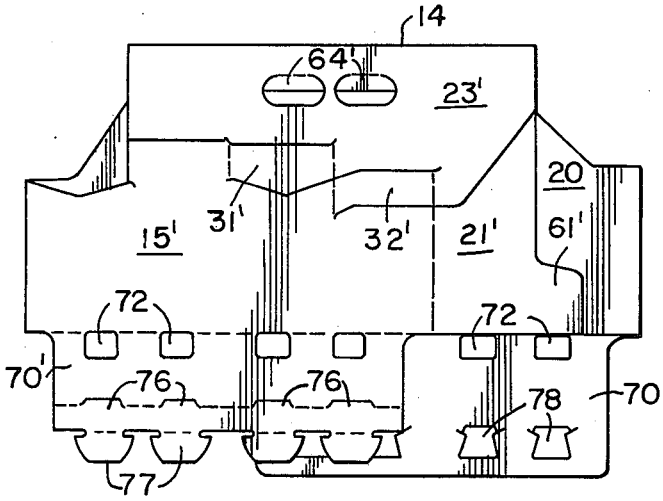

FIG. 7 is a plan view of the blank shown in FIGS. 5 and 6 following further folding and adhesive-applying operations; and FIG. 8 is a plan view of the completed carrier in flat, knocked down condition ready for delivery to a packaging line where it will be opened up and deposited on an assembly of bottles after which the bottom wall forming panels will be closed and latched to form a complete package.

Referring to the drawings, the illustrated form of the carrier is fabricated from a generally rectangular paperboard blank 10 which is cut and scored or creased as shown in FIG. 5. The blank 10 is divided into two generally rectangular sections 11 and 12 by a fold forming score line 14 with the two sections offset relative to each other along opposite sides of the score line 14. The blank sections 11 and 12 are divided into the various fold forming panel elements by substantially identical creasing and cutting lines by means of creasing and cutting dies which are substantially identical and which are arranged in offset and reversed relation to form the blank as shown. Since the cut and creased sections 11 and 12 are substantially identical, only one of these sections will be fully described, the same numerals primed being applied to the corresponding elements of the other section.

The side section 12 of the blank 10 is divided by transversely extending, longitudinally spaced crease or score lines and longitudinally extending cutting lines into a side wall panel 15 which extends between the parallel, spaced, transverse crease lines 16 and 17, end wall panels 20 and 21 at opposite ends of the side wall panels, which are separated therefrom by the crease lines 16 and 17, and partition and handle forming panels 22 and 23 which are taken from the inner portion of the blank section 12 and released for folding out of the plane thereof by the generally longitudinally extending cutting lines 24, 25, 26 and 27, the latter being spaced so as to co-operate with certain transverse score lines in forming a series of hingedly connected cross partition forming strap members 30, 31 and 32.

The cross strap 30, which is formed at the one side of the panel 22, is defined by the oppositely disposed, transversely spaced cutting line portions 33, 34 and the hinge forming, parallel, spaced, transverse cross lines 35 and 36 which are inner end extensions of the corner score line 16 and the parallel, transverse score line 37, the latter separating the panels 22 and 23 and constituting a fold line enabling the reinforcing panel 22 to be folded upon the main handle and partition panel 23. The distance between the score lines 35 and 36 corresponds to the body diameter of the bottle to be received in the carrier cells. The cross strap 31 is defined by the oppositely disposed, transversely spaced cutting line portions 40, 41 and the hinge forming, parallel, spaced, transverse score lines 42 and 43 which extend between the cutting line portions 40, 41 at a distance corresponding to the distance between the parallel score lines 35 and 36. The score lines 42, 43 are parallel with the score lines 35, 36 and score line 42 is spaced from score line 36 a distance corresponding to the distance between score lines 35 and 36. The cross strap 32 is defined by the oppositely disposed, transversely spaced cutting line portions 44, 45 and the hinge forming, parallel, spaced, transverse score lines 46 and 47 which extend between the cutting line portions 44 and 45 and which are spaced apart a distance corresponding to the spacing between transverse score lines 35 and 36.

Riser panels 50 and 51, of relatively narrow width, are provided at opposite ends of the blank section 12 which are separated from the end wall forming panels 20 and 21 by hinge forming transverse score lines 52 and 53 extending parallel with the score lines 16 and 17. The riser panel 30 is released at one end for folding on the score line 52 by a relatively short, longitudinal cutting line 54. At the other end the panel 50 is released by the end portion 55 of the cutting line 24. At the other end of the blank section 12 riser panel 51 is released at one end for folding about the score line 53 by a notched out portion 56 and at the other end by a cut out or slot 57 at the end of the score line 14.

The distance between the parallel score lines 16, 52 and 17, 53 corresponds to the body diameter of the bottles which the carrier is designed to accept and the panels 20, 21 constitute half end panels. The riser panels 50 and 51 terminate short of the outer side edge of the blank section 12 at the ends thereof leaving portions 60 and 61 which remain in the plane of the end wall forming half panels 20 and 21 and which constitute extensions of these panels at the bottom margins thereof in the set up carrier (FIGS. 2 and 3).

The cutting lines 24 and 27 each extend across the associated end half panel 20 and 21, with the portion 62 of the line 27 terminating at the score line 53. The inner end portion 63 of score line 53 forms a hinge line for the panel 23 when the carrier is opened up. The distance between the hinge forming score lines 37 and 63 corresponds to the distance between the hinge forming score lines 16 and 17 for the side wall 15 and the end wall panels 20 and 21. The handle portion of the panel 23 has a pair of finger hole cutouts 64 centered longitudinally between the score lines 37 and 63. The reinforcing panel 22 has a finger hole cutout 65 for alignment with one of the cutouts 64 while the end portion 55 of the cutting line 24 has a configuration providing an edge corresponding to a portion of the other finger hole cutout 64 so as to align with the latter when the panel 22 is folded about the hinge line 37 (FIG. 6). The corresponding handle and partition reinforcing panel 22′ of the blank section 11, is shortened to permit the desired positioning of the associated riser panel 50′ and provided with a cut end edge configuration 55′ which includes a portion corresponding to a portion of the one finger hole 64′ in the associated handle and partition panel 23′.

Bottom wall forming panels 70, 70′ are separated from the side wall panels 15 and 15′ by longitudinal score lines 71 and 71′. These panels 70, 70′ have a dimension transversely of the blank sufficient to permit overlap of the free outer margins when the carrier is set up and these panels are hinged into a common bottom wall forming plane. A series of spaced apertures 72 is provided along each of the score lines 71 and 71′ for receiving compression fingers which align the panels and facilitate mechanical interlocking of the locking and latching elements provided for connecting these panels, as illustrated in U.S. Pat. No. 3,474,590, dated Oct. 28, 1969. The one panel 70′ is provided in its free margin with a narrow locking panel 73 which is separated from the main body of the panel 70′ by a hinge forming score line 74. The score line 74 is interrupted by a series of generally C-shaped cuts 75 to provide locking tabs 76 while a series of aligned latching tongues or tabs 77 are formed on the outer edge which locking tabs 76 and latching fingers or tabs 77 are adapted to be inserted in interlocking relation in co-operating locking apertures 78 provided in the margin of the other bottom wall forming panel 70.

In forming the carrier from the cut and scored blank 10 a suitable adhesive is applied to those areas of the handle panels 23 and 23′ onto which the reinforcing panels 22, 22′ and riser panels 51, 51′ are to be folded, as shown in FIG. 5, after which the panels 22, 22′ and 51, 51′ are folded about the hinge lines 37, 37′ and 53, 53′, respectively. An adhesive is then applied to the panels 22, 22′ as shown in FIG. 6, and the panels 20, 20′ are then folded on the hinge lines 16, 16′ to the position shown in FIG. 7. An adhesive is applied to the handle panels 22′, 23′, the riser panels 50′, 51′ or 50, 51 and to portions 61, 61′ of the end wall panels 2, 21′ as shown in FIG. 7 whereupon the blank sections 11 and 12 may be folded over about the hinge line 14 to complete the fabrication of the carrier in collapsed condition as shown in FIG. 8. The application of the adhesive and the particular type of adhesive may be varied depending upon the equipment available for effecting the panel folding and connecting operations.

While the form of the carrier which is illustrated embodies cross partition straps which are disposed horizontally in the set up carrier the carrier may be formed with cross straps which are cut so as to be disposed in outwardly and downwardly slanted relation to the longitudinal center partition structure when the carrier is set up.

The carrier is adapted to be supplied in collapsed condition, as shown in FIG. 8, to the bottle packaging line where it is squared up and deposited on an assembly of bottles arranged in double row and transversely paired relation, after which the bottom forming panels 70, 70' are folded beneath the assembly of bottles and connected by engaging the locking and latching elements 76, 77 in the locking apertures 78 with the latching elements 77 disposed in upright, bottle separating position as shown in FIG. 3.

I claim:

1. A blank for fabricating a collapsible cellular bottle carrier which is formed from a generally rectangular sheet of paperboard or like material wherein the blank is divided by a longitudinal center fold forming crease line into two generally rectangular sections which sections are offset relative to each other in the longitudinal direction of the blank and wherein each of said blank sections is divided by cut and crease lines extending transversely relative to said center crease line into a side wall forming panel, end wall forming panels at the opposite ends of said side wall forming panel and a combination handle and partition forming panel extending along said center fold forming crease line, each of said end wall forming panels having a free marginal portion extending transversely relative to said center crease line, a relatively narrow riser panel cut in each said free transverse marginal portion which is separated therefrom by a hinge forming crease line extending transversely of said center crease line, each riser panel terminating short of the outer longitudinal side edge of the blank section so as to leave an integral portion of the associated end wall forming panel extending in the plane thereof and longitudinally beyond the crease line separating the riser panel therefrom, each said handle and partition forming panel being separated from the associated side and end wall forming panels by transversely spaced, longitudinally extending cutting lines, and transverse hinge forming longitudinally spaced crease lines extending between said cutting lines and co-operating therewith to define cross partition straps, and a hinge forming transverse crease line dividing each said handle and partition forming panel into a handle panel portion and a handle reinforcing panel portion with the handle reinforcing panel portions being taken from material at opposite ends in the longitudinal direction of said handle portions and from longitudinally opposite ends of said blank.

2. A collapsible multicellular bottle carrier formed from a cut and creased blank of foldable sheet material which carrier comprises, in set-up condition, oppositely disposed, longitudinally extending, transversely spaced, vertical side wall forming panels each having longitudinally spaced vertical end edges, a pair of end wall forming panels hinged to said vertical end edges of each said side wall forming panel so as to provide a hinged corner connection, each of said end wall forming panels having a marginal portion which is opposite the hinged connection with the end edge of the associated side wall panel, said marginal portion constituting a riser panel which is folded inwardly on a vertical hinge line and each said riser panel on each end wall forming panel being connected in face-to-face relation with the riser panel on the adjoining end wall forming panel which is connected on a vertical hinge line to the corresponding end edge of the side wall panel which is disposed opposite said associated side wall panel, a multipanel longitudinal center partition and handle structure extending in a vertical plane between said side wall panels which includes a pair of outer panels integrally connected on a hinge forming longitudinal center line and disposed in downwardly folded relation, said outer panels having longitudinally spaced vertical end edges, and inner reinforcing panels hinged to said outer panels at opposite end edges of said outer panels and sandwiched between said outer panels, each said outer panel being connected on a vertical hinge line to a riser panel and each pair of riser panels at each end of the carrier having top portions which are sandwiched between the panels constituting said center partition and handle structure, cross partition members in the form of relatively narrow panels extending between each said side wall panel and said longitudinal partition and handle structure, said cross partition members having opposite end portions integrally hinged to said side wall panels and integrally hinged to panels of the longitudinal partition and handle structure, said cross partition members being longitudinally spaced so as to divide the space on each side of said longitudinal center partition and handle structure into an equal number of bottle receiving cells, and bottom wall forming panels hingedly connected to bottom edge portions of said side wall forming panels which are adapted to be disposed in the plane of the respective side wall panels and offset relative to each other in the lengthwise direction when the carrier is collapsed by folding on hinge connections between the carrier side walls and end walls which constitute oppositely disposed, vertically extending corners of the carrier when the carrier is in set up condition, and said bottom wall forming panels having marginal portions opposite the hinged connections with the bottom edges of the side wall forming panels which marginal portions have interengaging locking and latching elements and which are overlapped and connected in coplanar relation by said co-operating interengaging locking and latching elements when the carrier is in said set up condition.

3. A collapsible multicellular bottle carrier as set forth in claim 1 wherein at least one of said riser panels at each end of the carrier terminates short of the bottom edge of the one end wall panel from the margin of which it is taken and wherein each said end wall panel has a marginal portion of substantial size extending in the plane thereof and disposed below said riser panel, which marginal portion bridges the connection between the riser panels and the end wall panels and which marginal portion is connected in overlying relation with a bottom portion of the other one of the associated end wall forming panels.

4. A collapsible cellular bottle carrier formed from a cut and creased blank of foldable sheet material which carrier comprises, in the set-up condition, oppositely disposed, longitudinally extending, laterally spaced side wall panels each having longitudinally spaced vertical end edges, a pair of end wall forming panels hingedly connected along one vertical edge of each of said panels to the opposite vertical end edges of each said side wall forming panel, each of said end wall forming panels having a marginal portion of substantial width which is opposite the hinged connection with the associated side wall panel and in which there is cut a riser panel of lesser vertical dimension than the vertical dimension of the marginal portion which riser panel is connected thereto on a vertical hinge line, the riser panel on each end wall forming panel being folded inwardly of the carrier and connected in face-to-face relation with the riser panel on the associated end wall forming panel, a longitudinal center partition and handle structure extending in a vertical plane midway between said spaced side wall panels which partition and handle structure includes outer panels folded about a longitudinal center line into the plane of said partition and handle structure and inner reinforcing panels hinged to longitudinally opposite ends of said outer panels and sandwiched between said outer panels, each said outer panel having longitudinally spaced, vertical end edges and being connected on a vertical hinge line, at an end edge opposite the hinged connection thereof with the associated inner reinforcing panel, to a riser panel and each pair of riser panels at each end of the carrier having top portions which are secured between end portions of the panels constituting said center partition and handle structure, cross partition strap members each having end portions which are hinged to said side wall panels and other end portions which are hinged to the longitudinal partition and handle structure in longitudinally spaced relation so as to divide the space on each side of said longitudinal center partition and handle structure into an equal number of bottle receiving cells while permitting the side and end wall panels to collapse by folding at the hinged connections which are at longitudinally spaced, diagonally opposite corners, and bottom wall forming panels having longitudinal edges which are hinged to the bottom edges of said side wall forming panels and having means for connecting overlapped marginal portions of said bottom wall forming panels which are opposite the hinged connections of said bottom wall forming panels with the side walls when the carrier is in said setup condition.

5. A cellular bottle carrier as set forth in claim 4 wherein said end wall forming panels at each end of the carrier each have a portion extending at the edge opposite the hinged connection with the associated side wall panel which spans the connection between the end wall forming panels and which is secured in face engagement with a portion of the associated end wall panel so as to extend in the plane of the end and reinforce said end wall and the connection between the associated riser panels.

* * * * *